US005084914A

United States Patent [19]

Hesch

[11] Patent Number: 5,084,914

[45] Date of Patent: Feb. 4, 1992

[54] INVALID GARMENT

[76] Inventor: Mary Hesch, 137 E. 29th St., Erie, Pa. 16504

[21] Appl. No.: 604,132

[22] Filed: Oct. 19, 1990

[51] Int. Cl.[5] ..... A41D 1/06; A41D 13/12

[52] U.S. Cl. ..... 2/79; 2/83; 2/227; 2/DIG. 6; 2/DIG. 7

[58] Field of Search ..... 2/69, 78 B, DIG. 7, 2/DIG. 6, 79, 408, 114, 113, 404, 227, 83

[56] References Cited

U.S. PATENT DOCUMENTS

| | | | |
|---|---|---|---|
| 676,336 | 6/1901 | McGuire | 2/408 |
| 695,496 | 3/1902 | Schermerhorn | 2/114 |
| 2,010,483 | 8/1935 | Goodman | 2/78 B |
| 2,520,026 | 8/1950 | Beitchman | 2/DIG. 7 |
| 2,886,822 | 5/1959 | Matthews | 2/114 |
| 3,088,116 | 5/1963 | Simonoff | 2/79 |
| 3,111,680 | 11/1963 | Horowitz et al. | 2/227 |
| 3,140,718 | 7/1964 | Farkas | 128/527 |
| 3,144,659 | 8/1964 | Matthews | 2/114 |
| 3,208,454 | 9/1965 | Farkas | 128/527 |
| 3,828,785 | 8/1974 | Gamm et al. | 128/288 |
| 3,994,026 | 11/1976 | Sampey | 2/79 |
| 4,370,757 | 2/1983 | Richmond | 2/400 |
| 4,383,335 | 5/1983 | Slocum | 2/114 |
| 4,457,025 | 7/1984 | Meryash | 2/79 |
| 4,535,480 | 8/1985 | Kunieda | 2/79 |
| 4,570,268 | 2/1986 | Freeman | 2/DIG. 7 |
| 4,651,346 | 3/1987 | Hale | 2/69 |
| 4,651,353 | 3/1987 | Walden | 2/DIG. 6 |
| 4,833,731 | 5/1989 | Foxman | 2/DIG. 7 |
| 4,835,795 | 6/1989 | Lonon | 2/408 |
| 4,853,977 | 8/1989 | Foreman | 2/DIG. 7 |
| 4,864,657 | 9/1989 | Lake | 2/DIG. 7 |
| 4,914,756 | 4/1990 | Grassick | 2/DIG. 7 |

FOREIGN PATENT DOCUMENTS

| | | | |
|---|---|---|---|
| 114143 | 9/1929 | Austria | 2/79 |
| 602407 | 3/1926 | France | 2/69 |
| 41445 | 6/1925 | Norway | 2/79 |
| WO80/00527 | 4/1980 | PCT Int'l Appl. | 2/69 |

OTHER PUBLICATIONS

Gershman, Maurice, "Self Adhering Nylon Tapes," *Journal of AMA*, vol. 168, No. 7, Oct. 18, 1958.

*Primary Examiner*—Werner H. Schroeder
*Assistant Examiner*—Amy Brooke Vanatta
*Attorney, Agent, or Firm*—Charles L. Lovercheck; Wayne L. Lovercheck

[57] ABSTRACT

An invalid garment made up of a shirt and trousers. The shirt has a slit down the back from the collar to the tail and a slit down each side from a waistband position to the tail. The trousers have the seat removed from the waistband to the crotch. The waistband can be attached by VELCRO. A slit is formed down the rear of each of the legs of the trousers and VELCRO is provided down the slit so that the trousers can be placed over the patient's lap and the waist band and slit legs can be attached, thereby fitting a patient with a shirt and trousers.

7 Claims, 2 Drawing Sheets

INVALID GARMENT

BACKGROUND OF THE INVENTION

The present invention relates generally to an invalid garment and more particularly to a combination invalid shirt and trousers wherein a substantial portion of the seat of the trousers is removed providing an open seat. A waistband and the trouser legs are slit down the back from the open seat to the lower end of the legs and held closed with VELCRO type hook and loop closures. The waistband can be attached with VELCRO to hold the trousers in place on a person. The invalid shirt can be worn with the front part of the shirt tail in the trousers and the back part of the shirt tail outside covering the opening in the trousers seat.

Applicant is aware of the following patents that show various types of invalid garments and other related garments: U.S. Pat. Nos. 3,111,680 to Horowitz et al, 3,140,718 to Farkas, 3,208,454 to Farkas, 3,828,785 to Gamm et al, 3,994,026 to Sampey and 4,835,795 to Lonon. None of these patents show a garment that can be made up of a invalid shirt and trousers wherein the open seat of the trousers is removed and the invalid shirt tail covers the rear of the trousers. The legs are slit so that the trousers can be put onto a patient while the patient is in a sitting position and the shirt tail is allowed to cover the opening caused by the removed part of the trousers.

SUMMARY OF THE INVENTION

It is an object of the invention to provide an improved invalid garment.

Another object of the invention is to provide an invalid garment that is simple in construction, economical to manufacture and simple and efficient to use.

Another object of the invention is to provide an invalid garment, shirt and trousers, that can be put on a patient while the patient is in a sitting position or standing on both feet or lying down.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DESCRIPTION OF THE PREFERRED EMBODIMENT(S)

Figure 1:
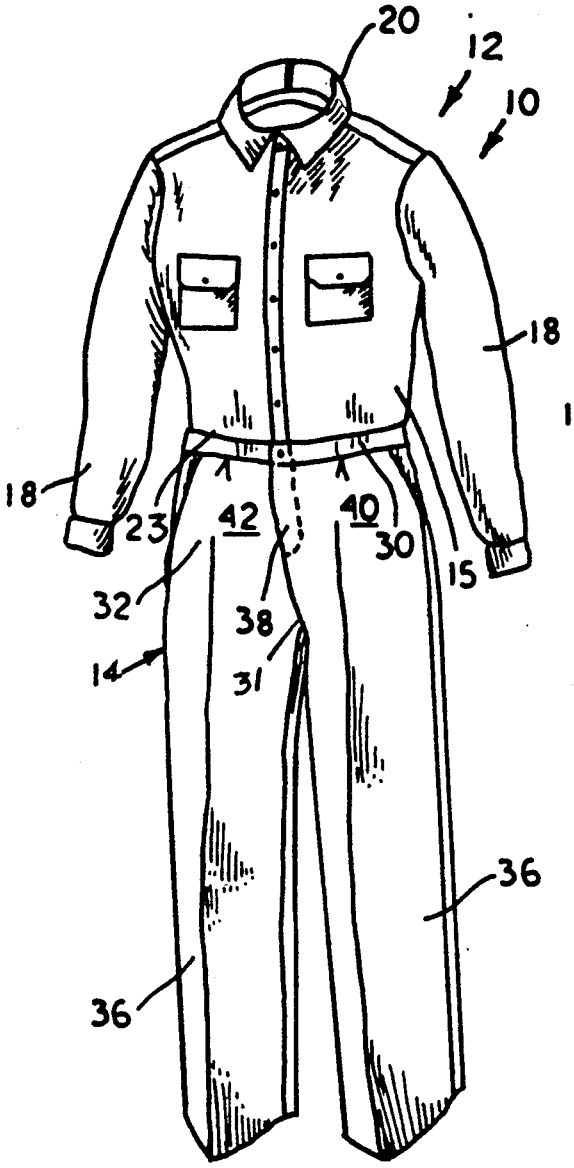
FIG. 1 is a front view of the invalid garment with the shirt tail tucked in the trousers, according to the invention.
Figure 2:
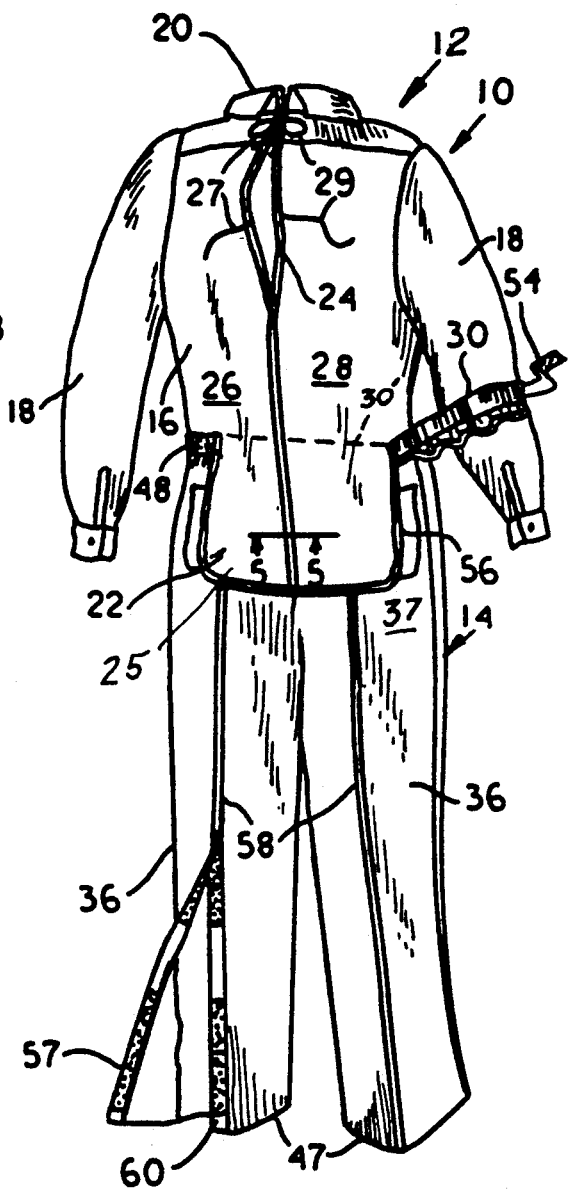
FIG. 2 is a rear view of the garment shown in FIG. 1 with the rear part of the shirt tail out of the trousers covering the open seat.
Figure 3:
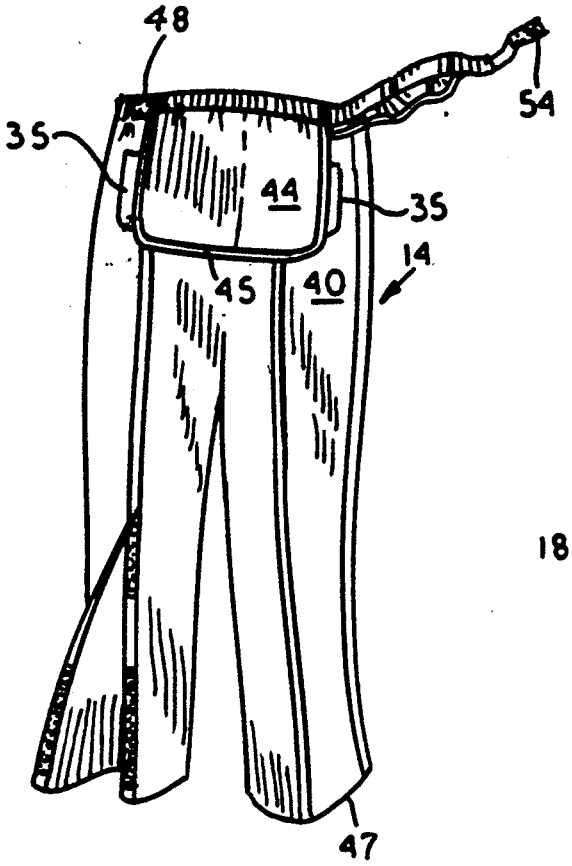
FIG. 3 is a rear view of the trousers according to the invention.
Figure 4:
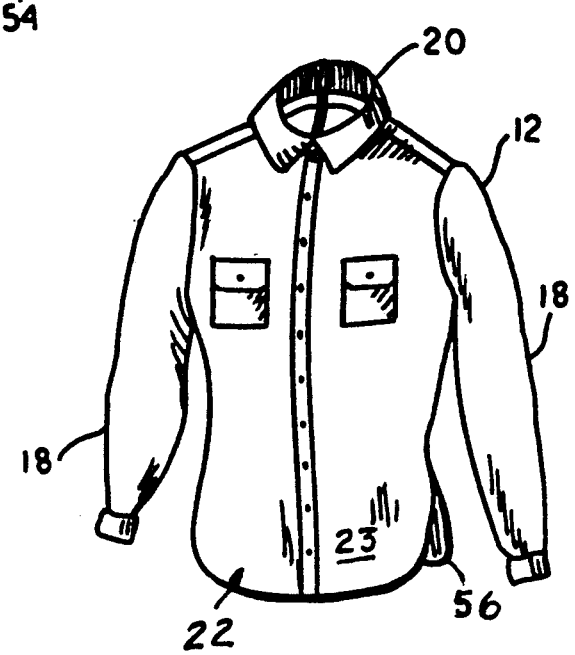
FIG. 4 is a front view of the invalid shirt according to the invention.
Figure 5:
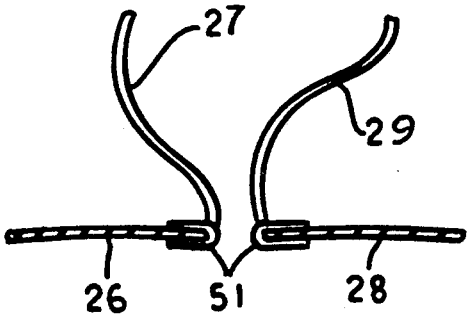
FIG. 5 is a cross sectional view taken on line 5—5 of FIG. 2.

Now with more particular reference to the drawing, invalid garment 10 is made up of invalid shirt 12 and trousers 14. Invalid shirt 12 has shirt front 15, shirt back 16, sleeves 18, collar 20 and shirt tail 22. Back 16 of invalid shirt 12 has slit 24 extending from collar 20 to shirt tail 22 dividing back 16 into first panel 26 and second panel 28. First attaching means 27 is attached to first panel 26 and is adapted to connect to second attaching means 29 on second panel 28 for removably connecting first panel 26 to second panel 28. First attaching means 27 and second attaching means 29, as shown, may be made up of tie strings which are of a type commonly used on hospital gowns, or the like, or the attaching means could be VELCRO.

Shirt tail 22 has side slits 56 separating front shirt tail part 23 from rear shirt tail part 25. Side slits 56 extend from waistband position 30' to the bottom of shirt tail 22. Waistband position 30' is be the position on invalid shirt 12 that a trousers waistband would normally engage a shirt. Front shirt tail part 23 is adapted to be worn inside trousers 14 and rear shirt tail part 25 is adapted to be worn outside trousers 14 overhanging open seat 44 of trousers 14 to conceal open seat 44.

Invalid shirt 12 can easily be removed by releasing first attaching means 27 and second attaching means 29 then lifting invalid shirt 12 off in a forward direction. Invalid shirt 12 has a seam along front 15 that is closed, but could be unbuttoned if necessary. Front buttons and back pockets are for decoration. Slit 24 at the rear of invalid shirt 12 has bindings 51 which are a type familiar to those skilled in the art.

Trousers 14 are made up of waistband 30, trousers front 32, open seat 44, back pockets 35, legs 36, crotch 31 and fly 38 which divides trousers front 32 into first side panel 40 and second side panel 42. Open seat 44 extends from waistband 30 to bottom hem 45. The sides of open seat 44 are also hemmed. Open seat 44 aids in changing trousers 14 since open seat 44 provides an opening between the patient and the object he is resting on.

Waistband 30 is attached to trousers 14 above open seat 44. First releasable means 48 and second releasable means 54 may be VELCRO or any other suitable attaching means.

Leg slit 58 is formed along the rear along the center of the back of legs 36 extending from bottom hem 45 of open seat 44 to lower end 47. Leg slits 58 are provided for convenience in changing trousers 14. VELCRO material may be used as a releasable means 48 and 54.

In order to change trousers 14, it is necessary to release first releasable means 48 and second releasable means 54 at waistband 30 and release first closing means 57 and second closing means 60, which may be VELCRO material, on legs 36 and lift trousers 14 forwardly off a patient in a sitting, standing or lying position. Replacing trousers 14 can be conveniently done for a patient, who may be either in a sitting, standing or lying position, by merely laying trousers 14 over the patient's lap and attaching waistband 30 by means of first releasable means 48 and second releasable means 54.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination, an invalid shirt and trousers, said trousers being adapted to extend around a person, said trousers having a waistband, and an open seat extending downward from said waistband, said invalid shirt having a front, a back, sleeves, a collar, a shirt tail, and a waistband region, said shirt tail extending from said waistband region to a bottom of said shirt, a slit in said back of said invalid shirt extending through said collar, through said shirt back and through said shirt tail thereby dividing said shirt back into a first panel and a second panel, first attaching means on said first panel adapted to be connected to second attaching means on said second panel for removably connecting said first panel to said second panel, a second slit in said invalid shirt extending from said waistband region through said shirt tail at a first side of said invalid shirt and a third slit in said invalid shirt extending from said waistband region through said shirt tail at a second side of said invalid shirt thereby dividing said shirt tail into a front shirt tail part adapted to be worn inside said waistband of said trousers and a rear shirt tail part adapted to overlie said open seat of said trousers, said trousers have a leg slit extending along the rear of each leg thereof from said open seat to a lower end of each said leg, first closing means and second closing means extending along edges of said slit adapted to close each said leg slit.

2. The combination recited in claim 1 wherein said trousers have spaced back pockets, said spaced back pockets have a bottom edge, and, said open seat of said trousers extends substantially from said waistband to said bottom edge of said spaced back pockets.

3. The combination recited in claim 2 wherein said waistband is attached to said trousers at a first side of said open seat and extending across said open seat, releasable means attaching said waistband to said trousers at a second side of said open seat.

4. The combination recited in claim 1 wherein said first attaching means and said second attaching means comprises tie strings attached to said invalid shirt at opposite sides of said slit in said back of said invalid shirt.

5. The combination recited in claim 3 wherein said releasable means comprises a VELCRO-type hook and loop fastener.

6. A method of making invalid trousers having legs terminating in lower ends, said method comprising cutting a seat part out of an ordinary pair of trousers having a waistband, cutting out said seat part below said waistband resulting in an open seat and leaving said waistband attached at one side of said open seat, providing a VELCRO-type hook and loop fastener on said waistband to attach said waist band to said trousers, cutting a leg slit in the rear of each said leg from said open seat to said lower end, providing closing means for holding each said leg slit of each said leg together.

7. A method of making an invalid shirt and trousers by providing a shirt having a collar, sleeves, a front, a back with a waistband position and a shirt tail, said trousers having a waistband, legs and a slit in each of said legs terminating at lower ends of said legs, said method further comprising forming a slit down said back of said shirt through said collar and through said shirt tail, providing attaching means on said back of said invalid shirt to hold said slit closed, forming side slits on each side of said shirt tail whereby said invalid shirt can be worn with a front shirt tail part of said shirt tail inside said trousers and a rear shirt tail part outside said trousers overlaying an open seat of said trousers, said method including cutting a seat out of an ordinary pair of trousers below a waistband resulting in an open seat and leaving said waistband attached at one side of said open seat, providing a VELCRO-type hook and loop fastener on said waistband to attach said waistband to said trousers, cutting a leg slit in the rear of each said leg from said lower end to an open bottom of said open seat, providing closing means on each side of each said leg slits for holding each said leg slit together.

* * * * *